US008875938B2

(12) United States Patent
Lacroix et al.

(10) Patent No.: US 8,875,938 B2
(45) Date of Patent: Nov. 4, 2014

(54) LID FOR PACKAGING CONTAINER AND METHOD OF FABRICATION

(71) Applicant: North America I.M.L. Containers, St-Placide (CA)

(72) Inventors: Bruno Lacroix, Bois-d'Amont (FR); Arnaud Joubert, Besançon (FR)

(73) Assignee: North America I.M.L. Containers, St-Placide, Quebec (CA)

( * ) Notice: Subject to any disclaimer, the term of this patent is extended or adjusted under 35 U.S.C. 154(b) by 0 days.

(21) Appl. No.: 13/755,571

(22) Filed: Jan. 31, 2013

(65) Prior Publication Data

US 2013/0193141 A1 Aug. 1, 2013

(30) Foreign Application Priority Data

Jan. 31, 2012 (FR) ..... 12 50880

(51) Int. Cl.

| | |
|---|---|
| ***B65D 41/16*** | (2006.01) |
| ***B65D 41/02*** | (2006.01) |
| ***B65D 43/02*** | (2006.01) |
| ***B65D 51/24*** | (2006.01) |

(52) U.S. Cl.

CPC ..... *B65D 41/02* (2013.01); *B65D 43/0212* (2013.01); *B65D 51/245* (2013.01); *B65D 2543/00092* (2013.01); *B65D 2543/0024* (2013.01); *B65D 2543/00296* (2013.01); *B65D 2543/00527* (2013.01); *B65D 2543/00537* (2013.01); *B65D 2543/0074* (2013.01); *B65D 2543/00796* (2013.01)

USPC ..... 220/795; 220/254.1; 220/254.7; 220/258.1; 220/780

(58) Field of Classification Search

USPC ..... 220/254.1, 254.7, 258.1, 270, 359.2, 220/780, 782, 793, 795; 156/73.1, 245

See application file for complete search history.

(56) References Cited

U.S. PATENT DOCUMENTS

| | | | | |
|---|---|---|---|---|
| 4,096,963 | A * | 6/1978 | Rumball | 215/317 |
| 5,950,861 | A * | 9/1999 | Roth et al. | 220/359.2 |
| 6,637,176 | B1 * | 10/2003 | Krall | 53/420 |
| 7,703,626 | B2 * | 4/2010 | Witt | 220/276 |
| 8,308,021 | B2 * | 11/2012 | Turvey et al. | 220/793 |

FOREIGN PATENT DOCUMENTS

| | | | |
|---|---|---|---|
| DE | 19540152 | A1 | 4/1997 |
| GB | 2030120 | A | 4/1980 |
| WO | 93/12978 | A1 | 7/1993 |

* cited by examiner

*Primary Examiner* — Jeffrey Allen
*Assistant Examiner* — Madison L Poos
(74) *Attorney, Agent, or Firm* — Norton Rose Fulbright Canada LLP

(57) ABSTRACT

Lid for a packaging container comprising an annular member of plastic, having an opening, engagement means adapted to cooperate with complementary engagement means provided on a container. An inner face is oriented toward the container, and an outer face opposite the inner face, and an annular support surface is on one of the inner face and outer face. A panel of plastic and molded separately from the annular member and comprises an inner face oriented toward the container, and an outer face opposite the inner face, one of the inner face and outer face of the panel being positioned on the annular support surface so as to form an overlapping portion to close at least partially the opening of the annular member. A welding joint is formed in the overlapping portion between the panel and the annular support surface to integrally fix the panel to the annular support surface.

10 Claims, 4 Drawing Sheets

LID FOR PACKAGING CONTAINER AND METHOD OF FABRICATION

TECHNICAL FIELD

The present invention relates to a lid for a packaging container and a method of manufacturing such lid.

BACKGROUND OF THE ART

From the prior art, lids for a packaging container are known to be produced by a process called IML (In-Mould Labelling, or Inner Mould Labelling). This method comprises depositing within a mold, a panel forming a label. The panel is positioned so that it may appear on the outer face of the finished product.

Thereafter, a plastic material for forming the support means of the panel and the body of the lid is heated at an elevated temperature and pressure, and injected into the mold. The panel is then secured to the plastic material to form the finished product.

Such a process, even while offering a perfect finish of the label, consumes a considerable amount of plastic, resulting in extra costs for the operator.

In order to overcome this drawback, it has been proposed to reduce the amount of plastic injected into the central part of the panel. However, under these conditions, the panel tends to wrinkle, making the inscriptions printed on it unreadable.

Also known from the document FR 2 827 841 is a lid for a packaging container composed of an annular member and a plastic panel. The annular member comprises an annular ridge arranged to cooperate with a complimentary ridge located on the container, so as to ensure the fixation of the lid to the container.

The annular member also comprises an annular projection extending radially and defining the periphery of an opening. This annular projection has an inner face intended to be turned towards the container, and an outer face opposite the inner face.

The panel comprises an inner face intended to be turned towards the container, and an outer face, printed opposite to the inner face.

During the manufacture of the lid, the annular member is overmolded onto the peripheral edge of the panel so that the outer face of the panel is secured in abutment against the inner face of the annular projection of the annular member.

Such a lid is disadvantageous in that, during overmolding of the annular member on the peripheral edge of the panel, the plastic material intended to form the annular member is brought to elevated temperature and pressure (e.g., 220° at 900 bar pressure) and then injected into the mold, resulting in the presence of thermal and mechanical stresses on the peripheral edge of the panel. When said injected plastic cools, the panel tends to retract.

Furthermore, it is common that the panel creases and as such, the printing performed on the outside of the front panel prior to the overmolding becomes unreadable after the overmolding or has an non-esthetic finish. This results in high scrap rates.

To overcome this drawback, it is known to increase the thickness of the panel in order to limit its contraction during the cooling of the injected material forming the annular member.

However, this results in an increase of the amount of plastic material used, and thus of the manufacturing cost of the lid.

Such a lid is also disadvantageous in that when pressure is exerted on the outer face of the panel, for example, when stacking a plurality of packaging containers, the panel tends to separate from the annular member, and a gap may appear between the panel and the annular member, which is detrimental to the airtightness of the lid.

SUMMARY

It is an aim of the present disclosure to provide a lid for packing container that addresses issues related to the prior art.

It is a further aim of the present disclosure to provide a method of fabrication for producing a lid for packing container that addresses issues related to the prior art.

Therefore, in accordance with the present disclosure, there is provided a lid for a packaging container comprising:—an annular member of plastic material, having an opening, engagement means adapted to cooperate with complementary engagement means provided on a container, an inner face adapted to be oriented toward the container, an outer face opposite the inner face, and an annular support surface on one of the inner face and outer face;—a panel of plastic material and molded separately from the annular member and comprising an inner face adapted to be oriented toward the container, and an outer face opposite the inner face, one of the inner face and outer face of the panel being positioned on the annular support surface so as to form an overlapping portion and so as to close at least partially the opening of the annular member; and—a welding joint in the overlapping portion between the panel and the annular support surface to integrally fix the panel to the annular support surface.

Further in accordance with the present disclosure, there is provided a method for manufacturing a lid for a packaging container comprising: a) obtaining an annular member in plastic; b) obtaining a panel in plastic and molded separately from the annular member; c) positioning the panel on the annular member so as to define an overlapping portion between the panel and the annular member and so as to close at least partially an opening of the annular member, and d) welding a joint in the overlapping portion to fix the panel to the annular member.

In the description, the term "annular" must be understood in its broadest sense, that is to say, any member defining a closed loop which can be circular, rectangular, triangular, oblong, oval or other.

More specifically, the peripheral edge of the inner face of the panel is attached and fixed to the supporting surface of the annular member.

It should be understood that the panel and the annular member are not overmolded but are manufactured independently of one another, and then mounted and fixed on top of one another, for example by heat welding or gluing.

The lid according to the invention is advantageous in that the fixing of the panel to the annular member serves to limit the thermal and mechanical constraints applied on the peripheral edge of the annular member. For example, when the inner face of the panel is fixed to the support surface of the annular member by thermal welding, the applied pressure is of the order of (180° at 1 kN of force) and the temperature is about 200° C.

Advantageously, the inner face of the panel is fixed against the support surface of the annular member by thermal welding.

By "thermal welding" it is meant a welding method in which the elements to be fixed are on the one hand compressed locally on each other and on the other, heated locally so as to cause the fusion of the elements and the fixation of these elements during cooling.

Fixing by heat sealing requires the use of a press developing a pressure lower than for attachment by overmolding. Thus, the energy consumption resulting from the manufacture of lids according to the invention is minimized.

DESCRIPTION OF THE DRAWINGS

The invention will be better understood from the description which follows with reference to the attached schematic drawing, representing as an example, a lid for a packaging container according to the invention.

DETAILED DESCRIPTION

Figure 1:
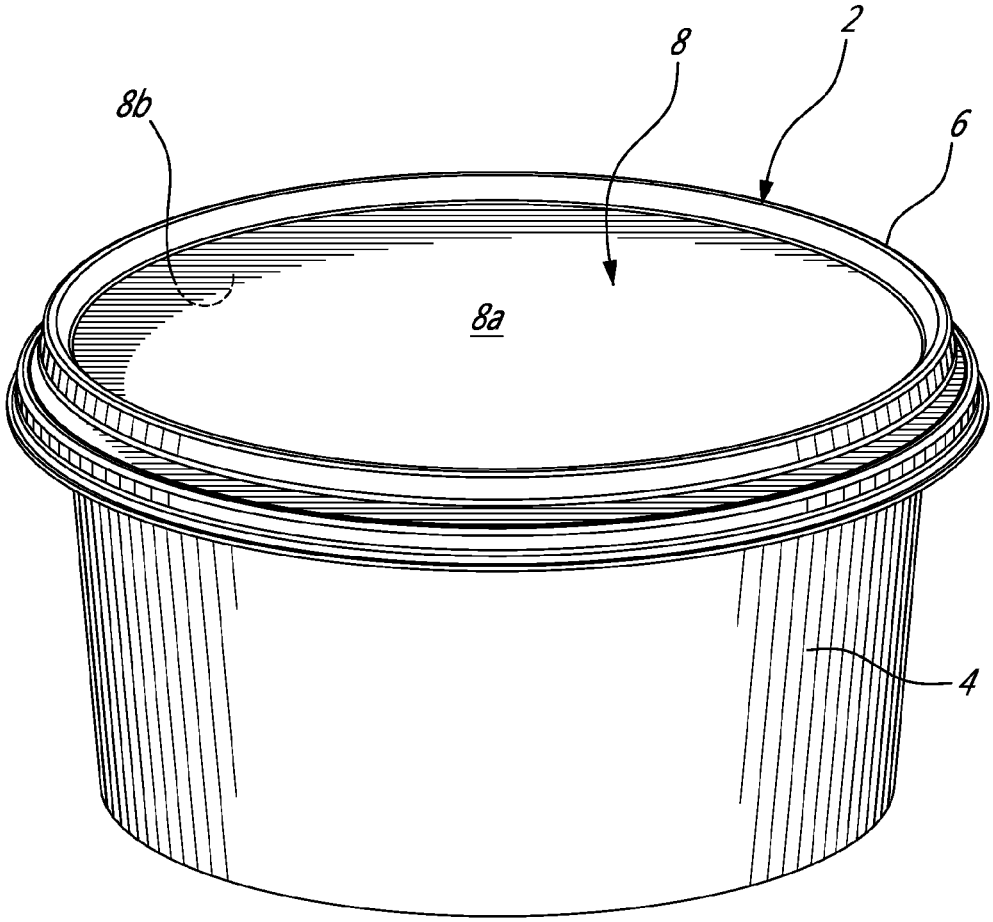
FIG. 1 is a perspective view of a lid in accordance with the present disclosure as mounted on a packaging container.

FIG. 1 shows a lid 2 for a packaging container 4. The lid 2 has a peripheral annular member 6 and a central panel 8 in plastic. According to an embodiment of the lid, the annular member 6 and the panel 8 are both made of thermoplastic material, for example polypropylene. The panel 8 is principally of the same material as the annular member 6 or a material compatible with that of the annular member 6 for thermal welding, post molding, as explained hereinafter. Inks, colors, etc may be present in the thermoplastic material. The annular member 6 and the panel 8 are fabricated separately from one another, and are hence separate, distinct pieces. This allows the annular member 6 to be thicker than the panel 8. For instance, the annular member 6 is about 500 microns in thickness, while the panel 8 is about 70 microns in thickness, namely a ratio of about 7.14, but appropriately between 5.0 and 9.0. The panel 8 has printing on at least one of its surfaces, typically the surface of the panel 8 that is exposed when the lid 2 is on the container. For instance, the panel 8 has logos, branding, content data, illustrations, nutritional facts, etc.

Figure 2:
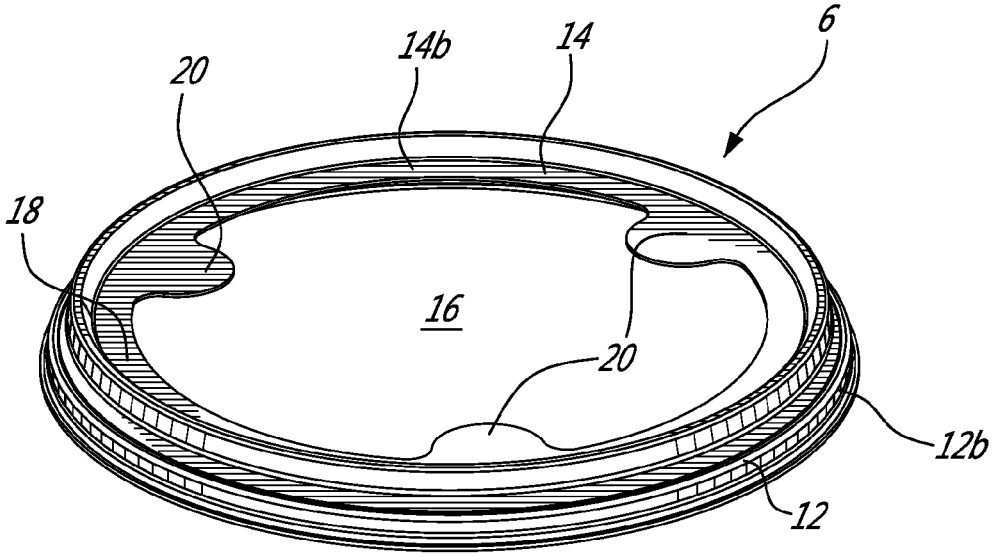
FIG. 2 is a perspective view from above of an annular member of the lid of FIG. 1.
Figure 3:
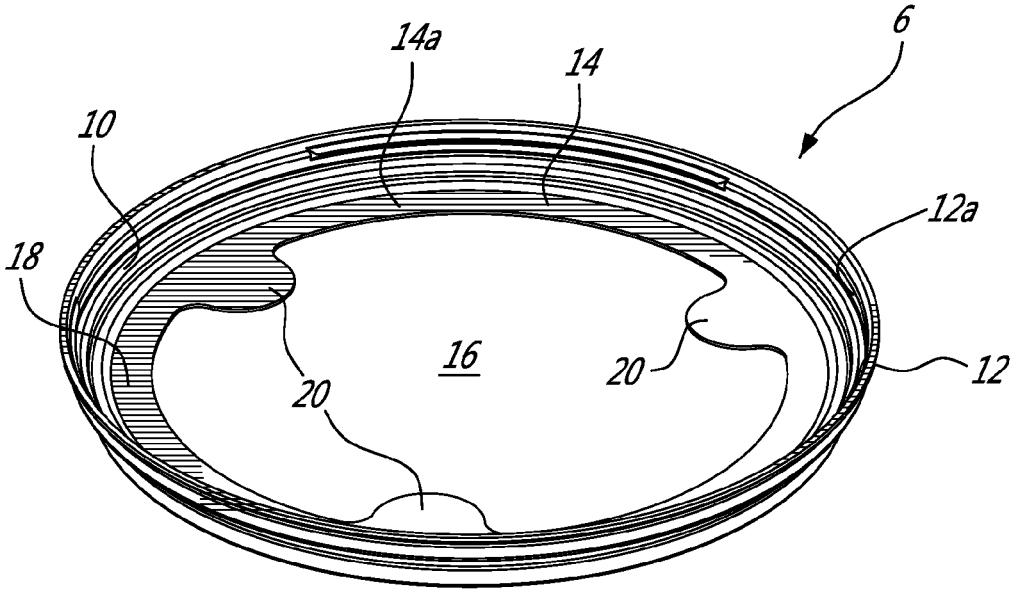
FIG. 3 is a perspective view from below of the annular member in FIG. 3.
Figure 4:
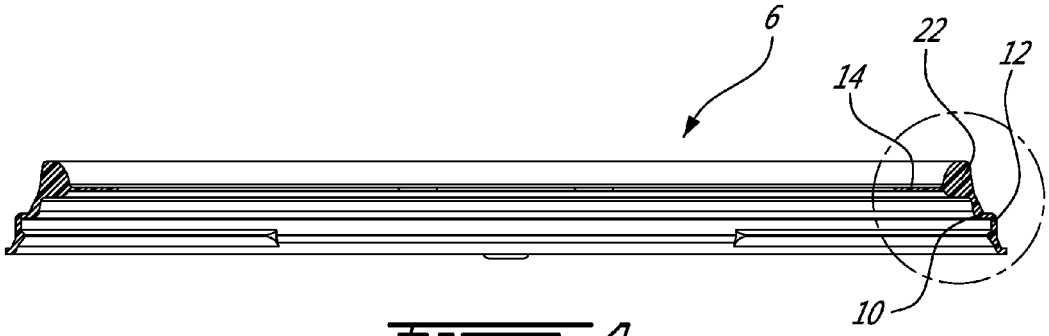
FIG. 4 is a sectional view of the annular member of FIG. 3.
Figure 5:
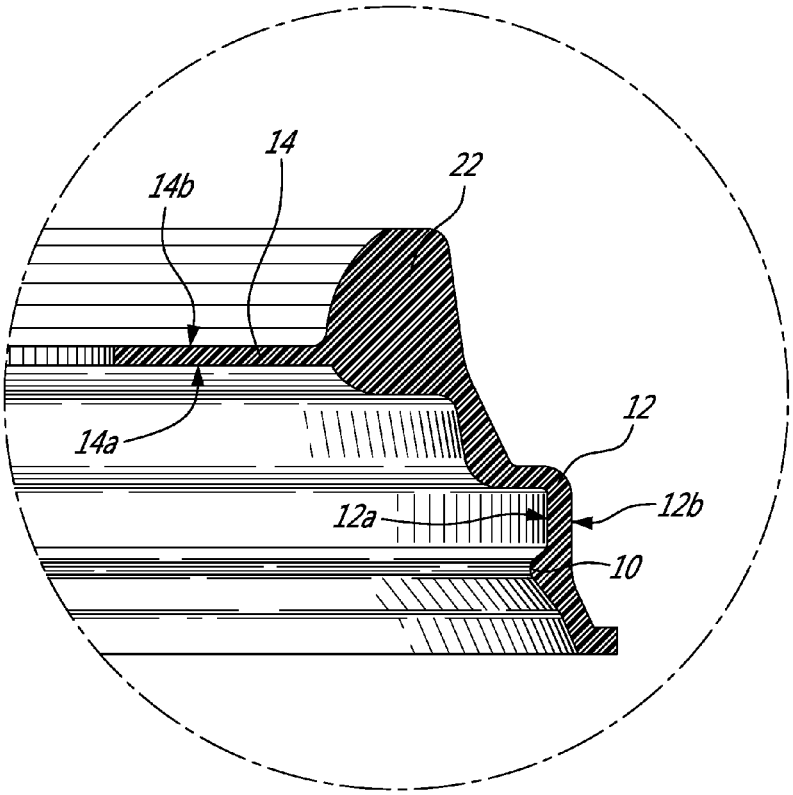
FIG. 5 is an enlarged sectional view of the annular member of FIG. 6.

The annular member 6 (shown in FIGS. 2 and 3) has a generally circular shape, but may also be oval, rectangular, elliptical, etc. The annular member 6 comprises engagement means adapted to cooperate with complementary engagement means provided on the container 4.

In the embodiment shown, the engagement means comprise an annular ridge or bulge 10 arranged to bear axially against an annular bulge or ridge formed on the container 4, when the lid 2 is mounted on the container 4. Those are one example of many engagement means that can be used, such as threading engagement (tapping and threading), complementary tabs, hooks and abutments, etc.

The annular member 6 comprises gripping means for manually displacing the ridge 10 radially by plastic deformation of the annular member 6, when the lid 2 is mounted to the container 4.

In the embodiment shown, the gripping means include an annular skirt 12 having an inner face 12*a* facing the container 4 and an outer face 12*b* opposite to the inner face 12*a*. The ridge 10 is formed on the inner face 12*a*. Other configurations are possible, such as a lip, a tamper-proof flange, etc.

The annular member 6 comprises an annular projection 14 extending radially inward. The projection 14 defines the perimeter of an opening 16 of the annular member 6.

The projection 14 has an inner face 14*a* oriented toward the container 4 and an outer face 14*b* opposite to the inner face 14*a*, the latter forming an annular support surface (i.e., a bearing surface). The annular support surface could also be on the outer face 14*b*.

The projection 14 includes a peripheral band 18, and may further include a plurality of tabs 20 extending from the band 18 in the direction of the center of the opening 16. The tabs 20 will increase an overlapping surface between the annular member 6 and the panel 8.

The annular member 6 has an annular projection 22 extending axially upwardly and about the projection 14. The projection 22 defines a contour substantially identical to the contour of the panel 8, as the projection 22 is essentially superposed on the upper edge of the container 4.

The panel 8 may be a single layer panel (or multi-layer panel). The panel 8 includes an inner face 8*a* facing the container 4, and an outer face 8*b*, printed as described above, opposite to the inner surface 8*a*. In the illustrated embodiment, an overlapping portion is formed by positioning the panel 8 onto the annular member 6. In the illustrated embodiment, the inner face 8*a* of the panel 8 is mounted on the outer face 14*b* of the projection 14 of the annular member 6. The peripheral edge of the inner face 8*a* of the panel 8 is then fixed by welding to the outer face 14*b* of the projection 14, thereby forming a welding joint, to form an integral lid produced post-molding. The panel 8 may have other features, such as an opening (for a straw), perforations, etc.

Figure 6:
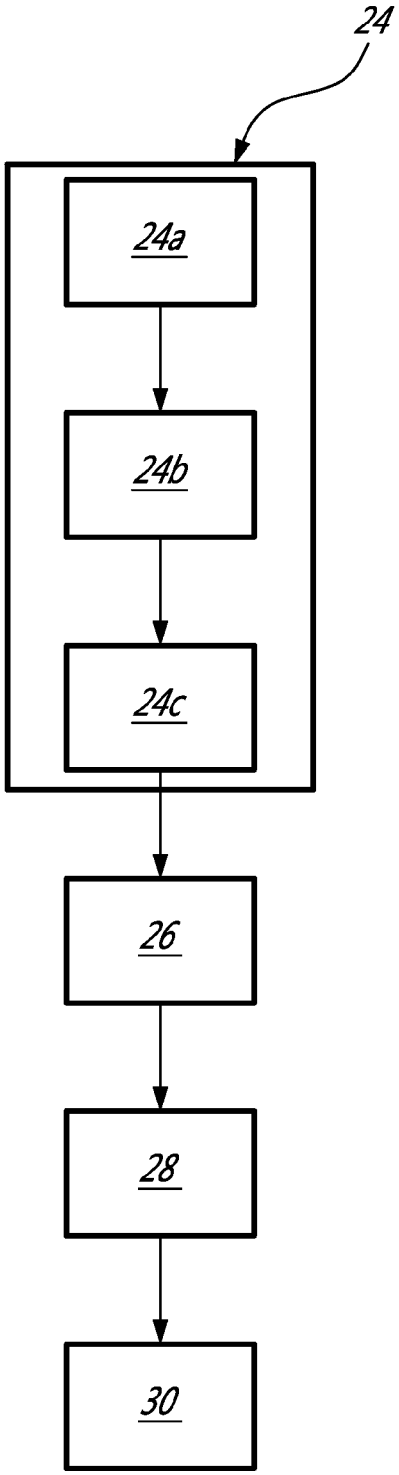
FIG. 6 is a flowchart of a method of manufacturing the lid of FIG. 1.

A method of manufacturing of the lid is described with reference to FIG. 6.

In step 24, the annular member 6 is obtained. For this purpose, during an operation 24*a*, a mold suitable for the production of the annular member 6 is used.

In an operation 24*b*, the melted polypropylene (fused in a viscous state) is injected into said mold so as to form the annular member 6.

In an operation 24*c*, the annular member 6 is removed or ejected from the mold.

In step 26, the panel 8 is obtained. The panel 8 is principally of the same material as the annular member 6 or a material compatible with that of the annular member 6 for welding, post molding.

In step 28, the panel 8 is positioned on the annular member 6 to form the overlapping portion. In the illustrated embodiment, the inner face 8*a* of the panel 8 bearing against the outer face 14*b* of the projection 14 so as to close the opening 16 of the annular member 6 tightly. During the positioning, the panel 8 is properly oriented for the printed information to be exposed when the lid 2 is on the container 4. Alternatively, the outer face 8*b* of the panel 8 may bear against the inner face 14*a* of the projection 14.

Finally, during step 30, a welding joint is formed in the overlapping portion. For instance, the peripheral edge of the inner face 8*a* of the panel 8 is secured by welding to the outer face 14*b* of the projection 14, thereby forming a welding joint between the annular member 6 and the panel 8. The tabs 20 may also be welded to the panel 8, thereby increasing the surface of the welding joint between the annular member 6 and the panel 8. The attachment of the annular member 6 and panel 8 is thus performed outside the mold (post-molding) used for the implementation of the operation 24*a*. Welding may be ultrasonic welding or thermal welding. By thermal welding, heat and pressure are applied in the overlapping portion between the annular member 6 and the panel 8 to form the joint.

It goes without saying that the invention is not only limited to the embodiments of the lid and the manufacturing process described above, as it encompasses all variants of realization.

The invention claimed is:

1. Lid for a packaging container comprising:

an annular member of plastic material, having an opening, engagement means adapted to cooperate with complementary engagement means provided on a container, an inner face adapted to be oriented toward the container, an outer face opposite the inner face, and an annular support surface on one of the inner face and outer face, the annular surface being provided on first annular projection extending radially, defining a perimeter of the opening, the first annular projection comprising a peripheral band, and a plurality of tabs extending from the band toward the opening;

a panel of plastic material and molded separately from the annular member and comprising an inner face adapted to be oriented toward the container, and an outer face opposite the inner face, a single one of the inner face and outer face of the panel being positioned on the annular support surface so as to form an overlapping portion and so as to close at least partially the opening of the annular member, while the other one of the inner face and outer face of the panel is free from contact with a remainder of the lid; and a welding joint in the overlapping portion between the panel, the peripheral band and the tabs to integrally fix the panel to the annular support surface solely by the welding joint between the single one of the inner face and outer face of the panel and the annular support surface.

2. Lid according to claim 1, wherein the annular member comprises a second annular projection extending axially about and above the support surface.

3. Lid according to claim 2, wherein the second annular projection defines a shape substantially identical to a contour of the panel.

4. Lid according to claim 1, wherein the annular member and the panel are made of a same thermoplastic material.

5. Lid according to claim 1, wherein the engagement means comprises an annular ridge, the annular ridge adapted to bear axially against an annular ridge formed on the container when the lid is engaged to the container.

6. Lid according to claim 1, wherein the annular member comprises gripping means for manually displacing the ridge radially, when the lid is mounted on the container.

7. Lid according to claim 6, wherein the gripping means is a skirt adapted to receive a portion of the container.

8. Lid according to claim 1, wherein a ratio of thickness between the annular member and the panel is between 5 and 9.

9. Lid according to claim 1, wherein the welding joint is one of a thermal welding joint and an ultrasound welding joint.

10. Lid according to claim 1, wherein the single one of the surfaces is the inner face of the panel against the outer face of the annular support surface of the annular member.

* * * * *